United States Patent [19]

Day

[11] Patent Number: 4,895,103

[45] **Date of Patent: * Jan. 23, 1990**

[54] AUTOMATIC CLEANING METHOD FOR IMAGE DEVELOPMENT APPARATUS

[75] Inventor: Gene F. Day, Hillsborough, Calif.

[73] Assignee: Precision Image Corporation, Redwood City, Calif.

[ * ] Notice: The portion of the term of this patent subsequent to Jan. 24, 2006 has been disclaimed.

[21] Appl. No.: 235,006

[22] Filed: Aug. 22, 1988

Related U.S. Application Data

[63] Continuation-in-part of Ser. No. 77,104, Jul. 23, 1987, Pat. No. 4,799,452.

[51] Int. Cl.[4] ..... G03G 15/21

[52] U.S. Cl. ..... 118/652; 355/307; 430/125

[58] Field of Search ..... 118/652, 645; 346/157; 355/326, 256–258, 296, 307, 326; 430/125, 45, 117–119

[56] References Cited

U.S. PATENT DOCUMENTS

| | | | |
|---|---|---|---|
| 3,129,115 | 4/1964 | Clark et al. | 118/637 |
| 3,900,003 | 8/1975 | Sato et al. | 118/637 |
| 4,157,219 | 6/1979 | Ohta et al. | 355/10 |
| 4,351,604 | 9/1982 | Karasawa et al. | 355/4 |
| 4,627,705 | 12/1986 | Landa et al. | 355/4 |
| 4,706,605 | 11/1987 | Bibl et al. | 118/631 |
| 4,799,452 | 1/1989 | Day | 355/257 X |

*Primary Examiner*—Joan H. Pendegrass
*Attorney, Agent, or Firm*—Thomas Schneck

[57] ABSTRACT

A method of cleaning a circulation path of an image developing apparatus using liquid toners. Liquid dispersant is continuously circulated from its supply tank by a pump along lines to a toner applicator then back to the supply tank. Color concentrates containing charge bearing solid pigment particles are selectively injected and mixed with the dispersant by means of pumps or valves to form liquid toner only when developing a latent image is desired. When toner application is completed, the injection of color concentrate into the dispersant is stopped, and the liquid dispersant then automatically rinses the liquid toner out of the circulation path.

12 Claims, 3 Drawing Sheets

AUTOMATIC CLEANING METHOD FOR IMAGE DEVELOPMENT APPARATUS

CROSS-REFERENCE TO RELATED APPLICATION

This is a continuation-in-part of application Ser. No. 77,104 now U.S. Pat. No. 4,799,452, filed July 23, 1987.

TECHNICAL FIELD

The present invention relates to electrographic printers and electrophotographic copiers and printers using a liquid toner for developing a latent image.

BACKGROUND ART

In electrographic printing and copying, toner compositions are applied to an electrostatic latent image formed on a dielectric surface in order to develop, i.e. make visible, the image. The dielectric surface may be a coating on a sheet or web of paper to which toner is applied. Alternatively, the dielectric surface may be the charge retentive surface of a drum, belt or the like from which toner applied thereto is transferred to a sheet or web of plain paper. The electrostatic latent image may be established through electrostatic induction by a charged writing head, by ion projection, or through photoconduction, as in electrophotographic copiers or laser printers. Typically, the toner composition is a liquid having pigments or dyestuffs combined with a plastic or resinous binder, hereafter called "solid pigment particles" or "colorant", with very small amounts of added charge control agents, and dispersed in a large volume of liquid dispersant, primarily solvent. One commonly used solvent is an isoparaffinic hydrocarbon available under the tradename ISOPAR manufactured by Exxon Corporation. Multi-color electrostatic printers typically store liquid toner in storage tanks, one for each desired color, and selectively dispense the toner to one or more applicators as it is needed, to form a composite color image. Usually, any excess toner is returned to the appropriate supply tank for reuse.

In conventional electrostatic printers and copiers using liquid toner, the toning applicator must be prewet before it is used since it often dries out between use. Further, toning applicators must be periodically cleaned to remove toner particles caked or dried onto the shoe. Often this cleaning is done by hand with large amounts of a cleaning solvent, sometimes as frequently as once a day. This is a considerably messy task and results in a long time during which the printer or copier is not in use.

In U.S. Pat. No. 4,157,219, Ohta et al. describe a multicolor electrostatic imaging apparatus wherein different color liquid developers are supplied to a medium bearing an electrostatic latent image. The apparatus comprises leading and trailing squeeze rollers in horizontally spaced relation, a receptacle having a plurality of valved pipes connected to respective liquid tanks for applying a plurality of liquid developers and rinse liquid to the medium, and a carriage charging device disposed at the rear side of the trailing roller for neutralizing or dissipating the residual charge remaining on the medium after development. These components are mounted to a reciprocating carriage so that the latent image is successively subject to developing, squeezing and charging during carriage movement in a forward direction and to rinsing during carriage movement in the reverse direction. Such movements are repeated some desired number of times to make a multi-colored print.

In U.S. Pat. No. 3,129,115, Clark et al. describe a xerographic developing apparatus having two reservoirs of toner which are typically used separately. The first reservoir supplies developer liquid to a xerographic plate to form an image, while the other reservoir supplies liquid for cleaning the plate. All fluid from the xerographic plate is channeled into a third tank. Electrode plates within the third tank are charged to attract developer particles such that fluid with a predominance of particles is funneled into the first reservoir, while liquid with a significantly lower concentration of particles is funneled into the second reservoir. An object of the present invention is to provide an improved method of washing away residual solid pigment particles from common circulating and dispensing portions of an image developing apparatus of the type using liquid toner.

DISCLOSURE OF THE INVENTION

The above object has been met with a method in which a clear fluid dispersant is continuously circulated in an image developing apparatus from a supply tank to an applicator and back to the supply tank, and in which a selected color concentrate is injected and mixed into the dispersant stream only for an interval when toning is desired. When toning is no longer desired the concentrate injection is terminated, resulting in clear fluid circulating through the image development apparatus once again. While the fluid dispersant circulates all of the time, color toner for developing a latent image exists only intermittently. When any particular toner application step is completed, the injection pump for that color's concentrate is turned off, stopping the concentrate injection, and clear fluid flow resumes, providing automatic cleaning of the toner applicator and of all portions of the circulatory system common to all the various colors of toner.

The apparatus includes at least one tank of color concentrate containing charge bearing solid pigment particles, as well as the tank of clear dispersant. Following toner application, any excess toner fluid may be collected by a drain and the solid pigment particles electrically separated from the dispersant. Solids separation is carried out by a solids separator which includes an electrode, a particle accumulating surface moving past the electrode and a scraper blade or other means for removing pigment particles from the particle accumulating surface. The toner fluid is introduced at one end of the region defined between the electrode and the particle accumulating surface and flows to an exit aperture at the other end of the region. The electrode is biased to repel the charge bearing solid pigment particles, so that the particles are deposited on the particle accumulating surface. Substantially particle free liquid dispersant remains and is removed at the exit aperture and returned to its supply tank. The scraper blade or other means abuts against the particle accumulating surface so as to remove the agglomeration of particles from the particle accumulating surface. This color concentrate is returned to the appropriate tank.

An advantage of the invention is that the clear fluid rinse is not a distinct separate step requiring that an additional pump to be turned on then off. The clear fluid dispersant is always circulating, and when toning is complete, the fluid automatically washes out any solid residual matter in the circulation pathway and on the applicator surfaces. Further, because the clear fluid continually circulates, no prewetting of the applicator is required. Caking and drying of material on the applicator do not occur. One could also pre-wet the medium bearing the latent images with clear fluid, prior to toning, if desired. This pre-wetting reduces background staining of the medium because the clear fluid acts as a buffer between the medium and the particle bearing toner. Also, by adding conductive agents to the clear fluid, a post-wetting step could be used to eliminate any residual image charge from a color pass before beginning a subsequent color pass.

BEST MODE FOR CARRYING OUT THE INVENTION

Figure 1:
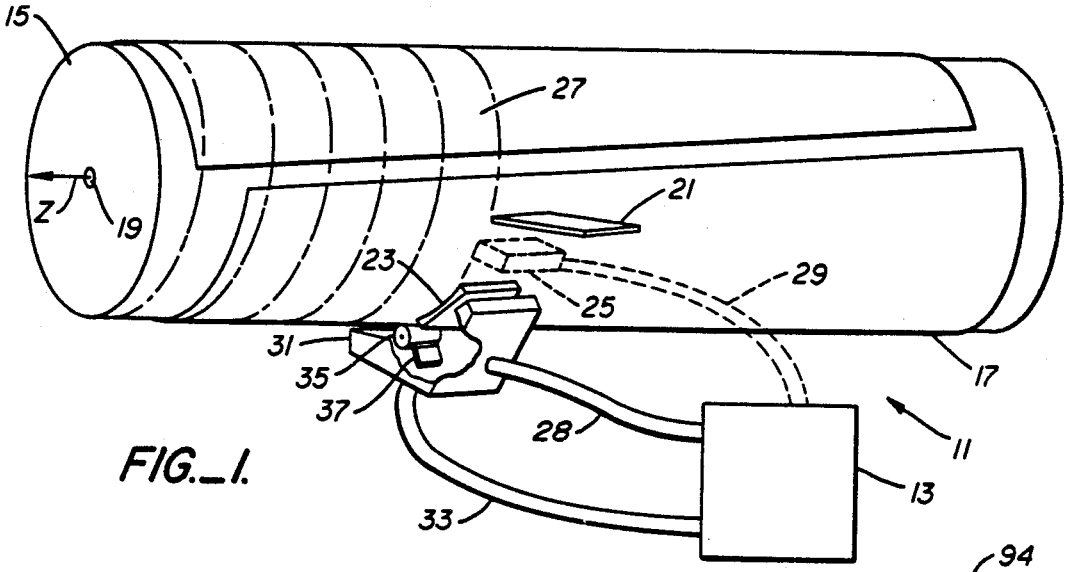
FIG. 1 is a perspective view of an electrostatic printer employing the automatic cleaning method of the present invention.

With reference to FIG. 1, an electrostatic printer 11 with a toner recycling system 13 employs an automatic cleaning method of the present invention described below. The toner recycling system 13 can also be used for developing nonelectrostatic media. In the electrostatic printer 11, a drum 15 supports a sheet of paper 17 for rotation. An axle 19 located on the longitudinal axis Z through the center of drum 15 supports the drum and transmits rotational energy from a motor, not shown. The size of drum 15 may vary, a large size drum typically having a diameter of approximately 12 inches and a width of approximately 52 inches. Sheet 17 is coated so that it is a charge retaining dielectric medium. Such sheets are commercially available, for example "Electrographic Paper" sold by James River Corporation. Alternatively, a latent image may be formed and developed directly on drum 15, and the developed image transferred to a sheet of plain paper.

An electrostatic head 21, for creating an electrostatic latent image, is in mechanical contact with the sheet 17, applying charge thereto. The head may comprise a linear array of wires forming charging elements, the forward edge of which is in very close proximity to the sheet 17. Head 21 is typically only a fraction of the width of a sheet and is translated laterally, parallel to the longitudinal axis Z of the drum 15 so that a helical stripe pattern 27, indicated by dashed lines, is traced on the sheet. Alternatively, head 21 may be a full width head which is fixed in position. The number of wires in a head may range from 100 to 20,000. The charging elements are at a negative potential of 400 to 600 volts relative to a drum at ground or at a positive potential. Polarities may be reversed.

A toner applicator 23 following head 21 applies liquid toner for developing a latent image existing in the charge pattern deposited on the sheet 17. The latent image created by the head 21 is thus formed into a visible image. Applicator 23 may be a toning shoe, as shown, which supplies the fluid toner locally to the sheet along the helical stripe pattern 27, or alternatively, may be a full drum width toning fountain or pool applicator. A prewet station 25, between the head 21 and the applicator 23 may be included to wet the latent image prior to toning with clear fluid dispersant, such as Isopar. This can enhance toning contrast and greatly reduce background marking.

Liquid toner is supplied to applicator 23 from the toner recycling system 13 of the present invention, discussed below, through an inlet tube 28. Likewise, if desired, clear dispersant may be supplied to the prewet station 25 from the toner recycling system 13 through a second inlet tube 29. Excess toner falls into a sump at the bottom of housing 31 for collection and return through drain tube 33 and the toner recycling system 13. A drying roller 35 is seen to also be carried within housing 31 and contacts drum 15 for removing excess developer. Once the excess is removed, it is scraped from the drying roller by a blade 37. Again, excess developer is collected and returned to the toner recycling system 13.

Figure 5:
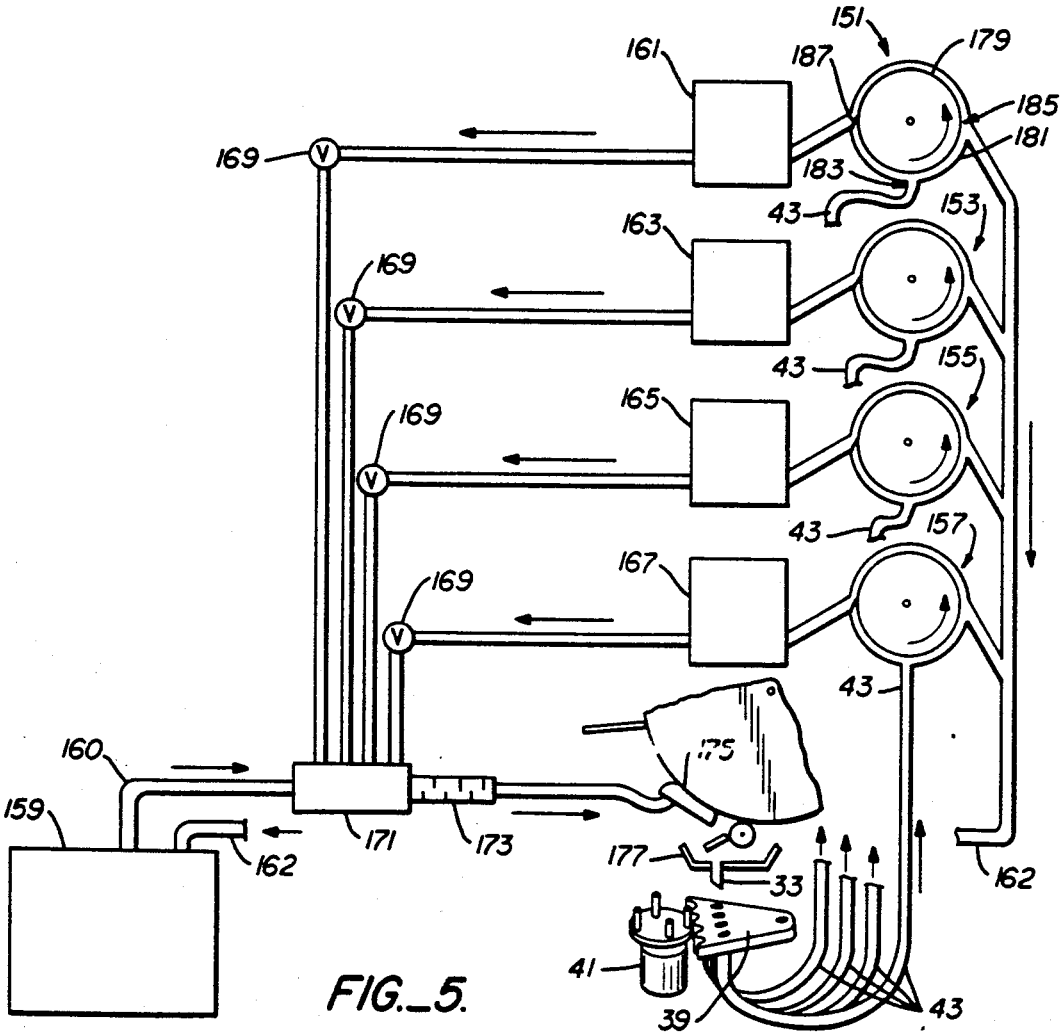
FIG. 5 is a schematic view of an alternate embodiment of a tone recycling system employing multiple solids separators.

The toner recycling system 13 typically includes a solids separator for separating pigment particles from the liquid dispersant component of the toner. Such a separator is capable of handling each color of liquid toner successively. Alternatively, the toner recycling system 13 may include a plurality of separate solids separators dedicated to each of the colors of liquid toner, as seen in FIG. 5. In the latter case, a drain selector foot 39 may be used to direct a particular color of excess toner to the appropriate solids separator. A motor 41 causes foot 41 to pivot so that an appropriate return tube 43, each leading to a different solids separator, is positioned under drain tube 33. Again, alternatively, an electromechanical valve with an inlet port and multiple selectable outlet ports may be used to direct the used fluid to the correct separator. Alternatively, four toner applicators, each with its own inlet and return lines, may be provided.

Figure 2:
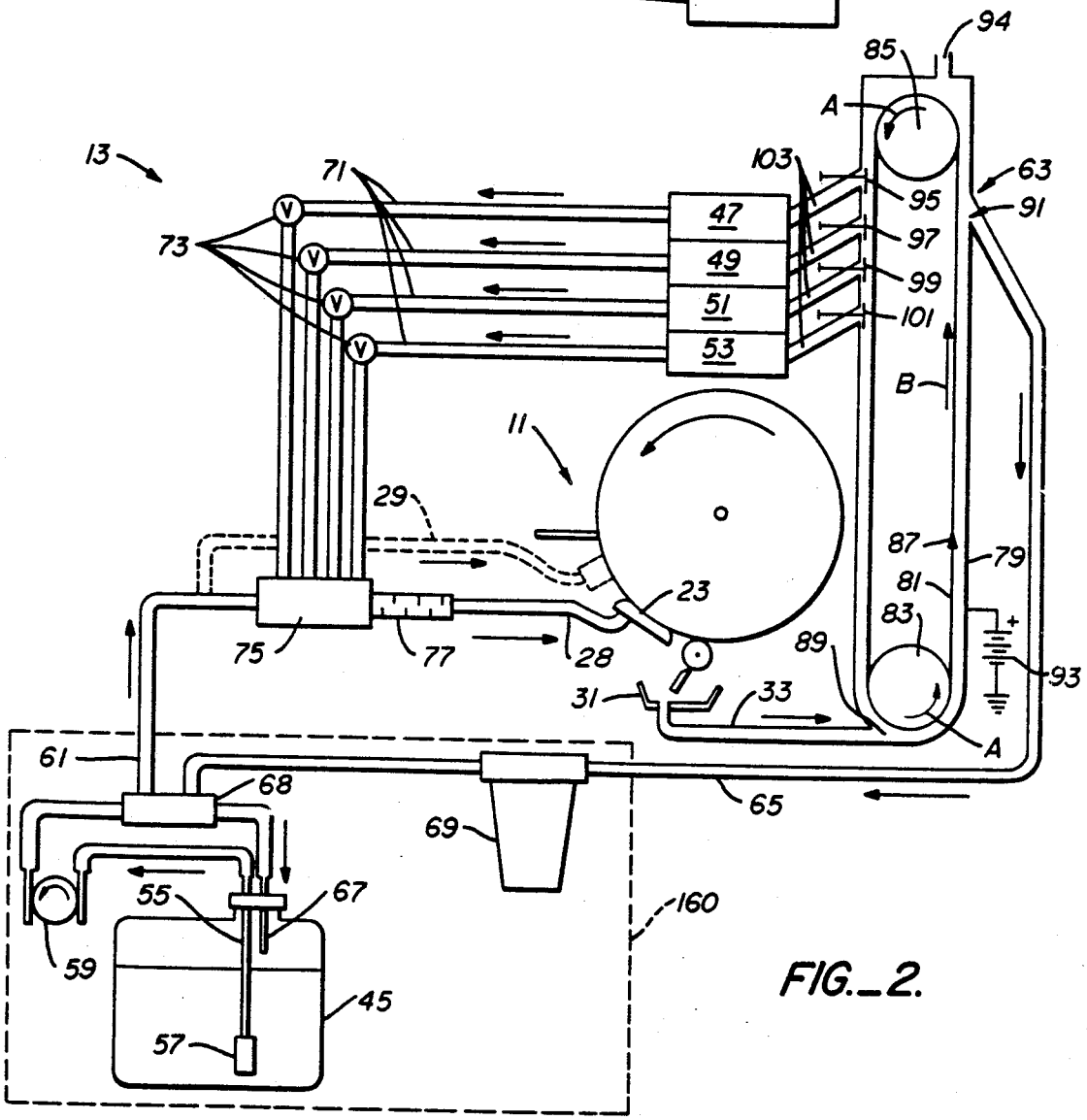
FIG. 2 is a schematic view of a toner recycling system in the electrostatic printer of FIG. 1, including a solids separator for separating pigment particles from toner.

With reference to FIG. 2, a toner recycling system 13 of the present invention, for use with electrostatic printers 11 and the like, is seen to include a supply tank 45 and a plurality of tanks 47, 49, 51 and 53 of color concentrate. The dispersant is primarily composed of a solvent such as Isopar. Isopar is a registered trademark of Exxon Co. for narrow cut isoparaffinic petroleum solvent consisting predominantly of C10 and C11 isoparaffinic hydrocarbons. Other solvents may also be used. The color concentrate contains charge bearing solid pigment particles, typically composed of a pigment or dyestuff coated or mixed with a plastic or resinous binder. Either the dispersant or the color concentrate or both may contain a small amount of charge control agent. Preferably, the dispersant and the liquid phase of the concentrates all contain the same concentration of charge control agent.

Dispersant is continuously pumped from supply tank 45 through an outlet 55 extending into supply tank 45 and terminating in a particle filter 57. Filter 57 is optional. Pumping is performed by a pump 59 which causes dispersant to be sucked up outlet 55 and sent along a feed line 61 toward the inlet tube 28 of applicator 23. An inlet tube 29 to an optional prewet station may branch off of feed line 61. Excess toner or dispersant is collected by a sump 31 which communicates via drain tube 33 with a solids separator 63. After any solid pigment particles have been separated, the dispersant returns to supply tank 45 via a return line 65 and a tank inlet 67. An aspirator 68 between feed and return lines 61 and 65 provides pressure to feed line 61 and suction to return line 65 to aid circulation. A filter 69 may be placed along the return line 65 to filter out any remaining particles from the dispersant. By this means, i.e. pump 59 and associated lines 55, 61, 28, 33, 65 and 67, a stream of dispersant is continuously circulated from the supply tank 45 to a toner fluid applicator 23 and back to the supply tank.

A set of concentrate feed lines 71 lead from the concentrate tanks 47, 49, 51 and 53 through injectors 73, which may be either injectors, valves or pumps, to an injection body or manifold 75 in the path of the circulating dispersant. Injectors 73 selectively inject an amount of a color concentrate into the stream of dispersant, by means of a particular valve opening or pump actuating or both. The amount of concentrate injected into the stream of dispersant may be controlled by varying the degree of valve opening or by varying the rate of pumping. Typically, the concentrate has a solids content in a range from 10–25% by volume. A mixer 77 between injector body 75 and applicator inlet tube 28 mixes the color concentrate and liquid dispersant, causing pigment particles to disperse in the liquid and forming liquid toner. A typical mixer operates by providing a tortuous path for the stream of dispersant with injected color concentrate. Alternatively, fluid turbulence may be used to insure uniform mixing. The resulting toner is applied to a latent image by an applicator 23, part of an electrostatic printer 11 or the like.

When a particular color pass is completed, the injector 73 for that color is turned off. Then fluid dispersant from tank 45 continues to be pumped through lines 55 and 61, through the injector body 75 and mixer 77 to applicator 23, then back along return line 65 via a solids separator 63. This continuous circulation of clear fluid dispersant enables the common portions of the toner circulation system, namely injector body 75, mixer 77, inlet tube 28, applicator 23, drain 31, drain tube 33, and solids separator 63, to be washed between successive applications of color toner.

A solids separator 63 in fluid communication with a drain 31 receives excess toner therefrom and separates out the pigment particles leaving substantially particle free dispersant. Solids separator 63 comprises an electrode 79, a particle accumulating surface, here a belt 81, and scraper blades 95, 97, 99 and 101. Belt 81 is an endless metal belt that turns on pulleys 83 and 85 rotating in the direction indicated by arrows A. In this manner, the belt continually moves past electrode 79 in the direction indicated by arrow B carrying toner along with it and continually presenting a clean surface to electrode 79. Belt 81 and electrode 79 are closely spaced, typically about 30 mil (762 microns) apart, and define a region 87 therebetween. An entrance aperture 89 at one end of region 87 receives excess liquid toner from drain tube or ribbon tube 33. An exit aperture 91 is defined at the opposite end of region 87 from entrance aperture 89 for removing clear liquid dispersant. Electrode 79 is electrically biased by a power supply 93 so as to repel solid pigment particles and drive the particle toward belt 81. Typically, electrode 79 has an electrical potential of about 4 kilovolts relative to belt 81, and acts like a capacitor. Pigment particles deposit and agglomerate on the belt surface to form a layer of color concentrate that is carried by the belt beyond the electrode 79 to the scraper blades 95, 97, 99, 101. As already noted, the remaining substantially particle free liquid dispersant is removed at the exit aperture 91 and returns along return line 65 to supply tank 45. A vent 94 may be provided in solids separator 63 to ensure free flow of fluids and effective aspirator suction. Alternatively, pumped flow or downward flow due to gravity may be used to cause the fluid to pass by electrode 79.

Scraper blades 95, 97, 99 and 101 are selectively actuated so as to abut belt 81 beyond electrode 79. Color concentrate removed from belt 81 by one of the scraper blades 95, 97, 99 and 101 returns to the appropriate concentrate tank 47, 49, 51 or 53 by way of concentrate return lines 103. For example, tanks 47, 49, 51 and 53 may contain yellow, magenta, cyan and black concentrate respectively. Scraper blade 95 actuates to return yellow concentrate to tank 47. Scraper blade 97 actuates to return magenta concentrate to tank 49. Scraper blade 99 actuates to return cyan concentrate to tank 51. Scraper blade 101 actuates to return black concentrate to tank 53. The number of concentrate tanks and the order of color concentrates may vary from the example given here.

Figure 3:
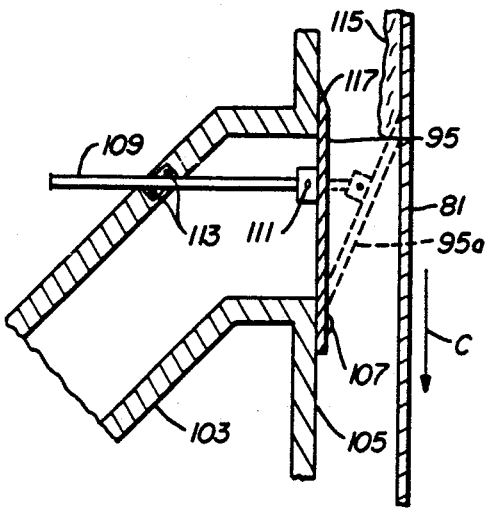
FIG. 3 is an expanded side section of a scraper blade of the solids separator in FIG. 2.

In FIG. 3, a detail of a scraper blade 95 is shown. Other scraper blades 97, 99 and 101 are similarly constructed. Blade 95 is mounted in front of a concentrate return line 103 leading to a tank of concentrate by means of a row of screws 107 inside housing 105 of the solids separator. Blade 95 is hinged to pivot against belt 81, as indicated by phantom blade **95*a* abutting belt 81. An actuating rod 109 is attached to blade 95 at a pivot 111.. O-ring seal 113 or the like in a wall of return line 103 prevents possible leakage. Rod 109** is typically solenoid actuated, but mechanical or other actuation means may also be used.

In operation, belt 81 contains a layer 115 of color concentrate and travels in a direction indicated by arrow C. Rod 109 pushes blade 95 into abutment against belt 81, i.e. into the position indicated by phantom blade **95*a*, so as to cause the layer 115 of color concentrate to be scraped off and returned to a tank via return line 103. Blade 95 is typically composed of a spring metal material, such as beryllium-copper alloy. With use, its end 117 abutting against belt 81 is worn flat for more effective scraping action. Withdrawing rod 109 causes blade 95 to close off return line 103**, preventing any contamination by other color concentrates.

Figure 4:
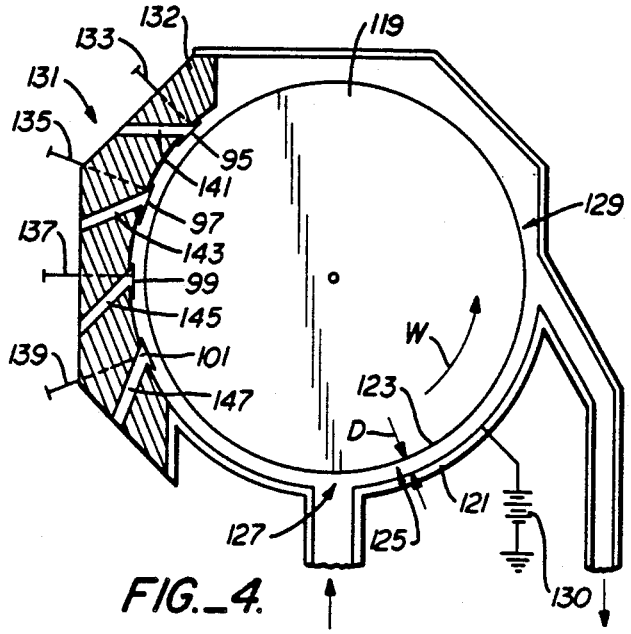
FIG. 4 is an alternate embodiment of a solids separator for use in the system of FIG. 2.

In FIG. 4, an alternate embodiment of solids separator 63 uses a drum 119 instead of belt 81 but otherwise operates in the same manner as the embodiment in FIG. 2. The solids separator has an electrode 121. As drum 119 rotates in the direction indicated by arrow W, the surface 123 of drum 119 moves past electrode 121, carrying liquid toner along in the region 125 between electrode 121 and drum surface 123. Drum surface 123 is spaced from electrode 121 by a small distance indicated by arrows D. Typically, drum 119 has a diameter of about 3 inches (7.6 cm) and a width of about 1.7 inches (4.3 cm). The spacing D between electrode 121 and drum surface 123 is typically about 15 mils (381 microns). At a drum rotation speed of about 400 RPM, liquid toner is pumped or carried past the electrode 121 in the region 125 at an average rate of about 12.6 $cm^3$/sec.

Excess toner is introduced into region 125 at an entrance aperture 127 at one end of region 125, is pumped past electrode 121, and the resulting dispersant with particles separated therefrom is returned to its supply tank at exit aperture 129. A power supply 130 biases electrode 121 to a potential of about 2 kilovolts relative to drum 119 so as to repel solid pigment particles, driving the particles toward drum surface 123. Sufficient separation of particles from dispersant is achieved for electrodes extending over at least a 90 degree arc of the drum. Shorter electrodes may be used with higher bias potentials.

The pigment particles, having been deposited onto drum surface 123 so as to form an agglomerated layer of color concentrate, are removed from the drum surface 123 at a concentrate removal station 131, and returned to the appropriate concentrate tank. Removal station 131 comprise blades 95, 97, 99 and 101 pivotally attached to a block 132 which are selectively pushed into abutment with drum surface 123 by rods 133, 135, 137 and 139. Passages 141, 143, 145 and 147 in block 132 conduct the removed concentrate to the appropriate tank. In construction and operation, removal station 131 is identical to that in FIG. 2, except that the housing 105 and return lines 103 are replaced with block 132 and passages 141, 143, 145 and 147 therein.

With reference to FIG. 5, an alternate embodiment of the toner recycling system of FIG. 2 has a plurality of dedicated solids selectors 151, 153, 155 and 157 instead of one common solids separator. Again, the system includes a dispersant supply subsystem 159, similar to that shown within the dashed lines 160 in FIG. 2, in which dispersant is circulated through lines 160 and 162 from a supply tank to an applicator and back to the supply tank by means of a pump. Tanks of color concentrate 161, 163, 165 and 167 communicate via pumps or valves 169 with a manifold 171 and a mixer 173 where color concentrate is injected and dispersed in the stream of liquid dispersant to form liquid toner. The liquid toner is then applied to a latent image by the applicator 175. Excess toner is collected by a drain 177 and delivered to the appropriate solids separator by a selector foot 39. Each solids separator 151, 153, 155 and 157 includes a particle accumulating surface such as a drum surface 179, and an electrode 181 biased to repel solid pigment particles. Toner is introduced into the region 185 between the electrode 181 and drum surface 179 at an entrance aperture and pumped or carried by the rotating drum to an exit aperture. Substantially particle free dispersant is returned to the supply tank. A fixed scraper blade 187 abuts the drum surface 179 and removes the layer of accumulated toner particles for return to the appropriate supply tank.

Figure 6:
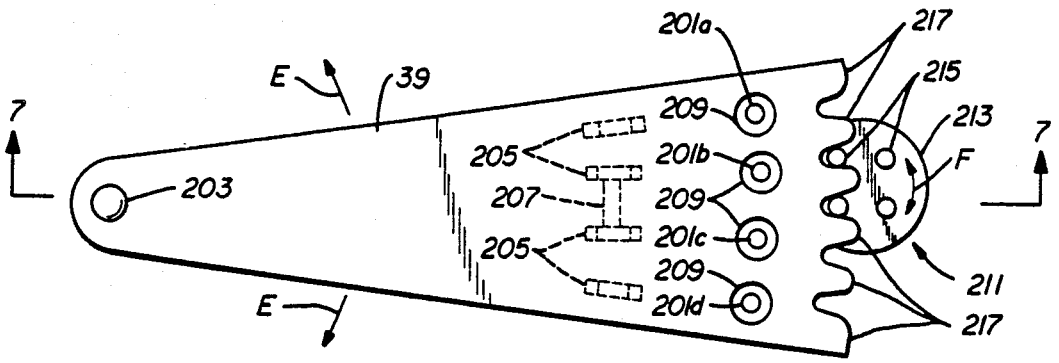
FIG. 6 is a plan view of a drain selector foot for use in the system of FIG. 5.
Figure 7:
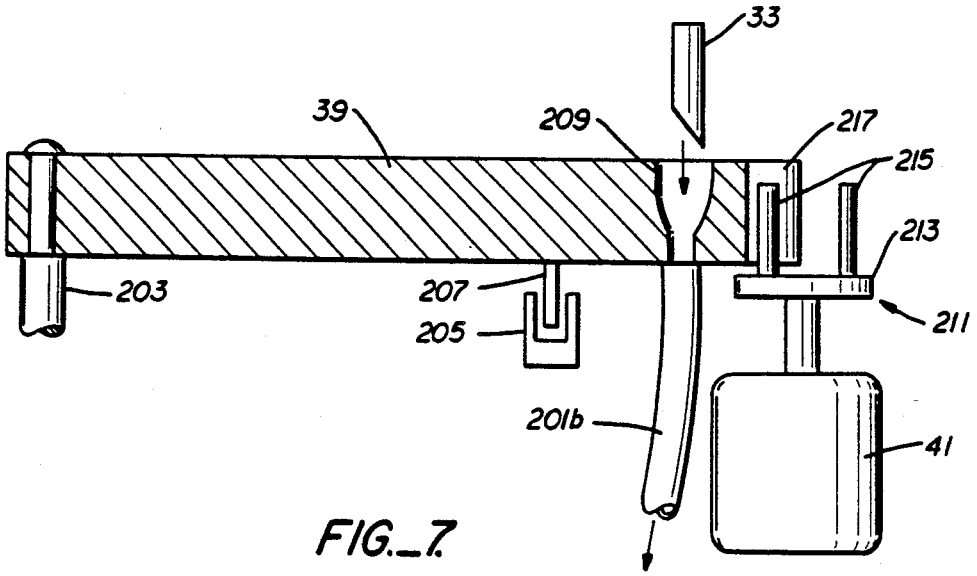
FIG. 7 is a side view of the drain selector foot in FIG. 6.

With reference to FIGS. 6 and 7, a drain selector foot 39 selects a return tube 201*a, b, c* or *d* for directing excess toner to the appropriate dedicated solids separator in FIG. 5. Foot 39 pivots about a post 203 at an end of foot 39 in either counterclockwise or clockwise direction, as indicated by arrows E. The position of foot 39 is indicated by optical sensors 205, each consisting of a light source and detector separated by a narrow space. A flag 207 depending from foot 39 passes through sensors 205 as the foot pivots, activating the sensors in sequence according to the position of the foot. The pivoting foot 39 brings one of four openings 209 into line beneath drain tube 33. Excess toner thus flows from drain tube 33 through an opening 209 and into a return tube 201*a, b, c* or *d* for delivery to a solids separator. Preferably, drain tube 33 is pointed like a quill to prevent drops of toner therein from staying in the drain tube 33.

Foot 39 is driven into a selected position by a peg disk drive 211 powered by a servo motor 41. Peg disk drive 211 comprises a disk 213 and four upstanding pegs 215 projecting from disk 213. Foot 39 has a plurality of toes 217, typically six in number, which extend from an end of foot 39 opposite post 203. The toes 217 define spaces therebetween which receive pegs 215. Disk 213 may turn in either clockwise or counterclockwise direction, as indicated by arrows F. Turning drive 211 forces a peg 215 engaging foot 39 to push against a toe 217, causing foot 39 to pivot. A new peg 215 moves into engagement with foot 39. Turning drive 211 clockwise pivots foot 39 counterclockwise, and vice versa.

The toner recycling system, whether containing one common solids separator or several dedicated solids separators, allows toners to be created only as needed from concentrates which are stored separately. When toning is not required, as, for example, at the end of a particular color pass, clear fluid dispersant continues to flow, but is not mixed with concentrate, thereby washing out any residual matter in the common toner-contacting portions of the circulating path and cleaning off the toner applicator automatically.

I claim:

1. In an image development apparatus applying liquid toner to a surface bearing a latent image, a method of automatically cleaning toner contacting portions of the image development apparatus comprising, continuously circulating a stream of clear fluid dispersant in a circulation path, periodically injecting color concentrate into said clear fluid dispersant to form a dispersant-concentrate mixture for toning a latent image, then decomposing the dispersant-concentrate mixture into clear dispersant and color concentrate after said toning said image so that said dispersant-concentrate mixture exists only during the toning of said latent image.

2. The method of claim 1 further defined by collecting and re-using said clear dispersant and color concentrate.

3. The method of claim 2 further defined by recirculating dispersant in said stream of clear fluid dispersant.

4. In an image development apparatus applying a liquid toner to a surface bearing a latent image, a method of automatically cleaning toner-contacting portions of the image development apparatus comprising, continuously circulating a stream of clear fluid dispersant in a circulation path from a first supply tank to a toner fluid applicator and back to said supply tank, injecting and mixing color concentrate from a second supply tank into said stream of clear fluid dispersant to form a stream of liquid toner only in time periods when toner is to be applied to a surface bearing a latent image, collecting excess and used toner and then decomposing said excess and used toner to reobtain clear dispersant and color concentrate, returning said clear fluid dispersant and said color concentrate to respective first and second supply tanks, and stopping said injecting of color concentrate at the end of each toner application time period, whereby said continuously circulating stream of fluid dispersant rinses clear said toner fluid applicator and other portions of said circulation path having had contact with said liquid toner.

5. The method of claim 4 wherein injecting and stopping said injecting said color concentrate comprises turning a pump on and off, respectively.

6. The method of claim 4 further defined by treating said excess toner electrically so as to separate charge-bearing solid pigment particles from said toner, substantially particle-free fluid dispersant being returned to said supply tank, said particles collecting on a particle accumulating surface and subsequently removed from said accumulating surface for return to a concentrate tank.

7. The method of claim 4 further comprising pre-wetting said surface bearing a latent image with fluid dispersant prior to applying toner to said surface.

8. The method of claim 4 further defined by a first color concentrate being injected into said stream of fluid dispersant to form a first fluid toner, injection of said first color concentrate being stopped at an end of a first time period and thereafter rinsing said first fluid toner from said circulation path, and a second color concentrate being injected into said stream of fluid dispersant to form a second fluid toner, injection of said second color concentrate being stopped at an end of a second time period and thereafter rinsing said second fluid toner from said circulation path.

9. A method of automatically cleaning toner-contacting portions of an electrostatic color printer comprising, continuously circulating a stream of fluid dispersant in a circulation path from a supply tank to a toner fluid applicator and back to said supply tank, injecting and mixing a color concentrate containing charge-bearing solid pigment particles of a first color into said stream of fluid dispersant to form a first liquid toner during a first time period, said toner being applied at said toner fluid applicator to a surface bearing a first electrostatic latent image during said first time period, excess toner being collected and electrically treated so as to separate said charge-bearing solid pigment particles therefrom, substantially particle-free dispersant obtained thereby being returned to said supply tank, stopping said injecting of said color concentrate at an end of said first time period, whereby said continuously circulating stream of fluid dispersant rinses said first fluid toner from said circulation path, injecting and mixing a color concentrate containing charge-bearing solid pigment particles of a second color into said stream of fluid dispersant to form a second liquid toner during a second time period, said second toner being applied at said toner fluid applicator to said surface bearing a second electrostatic latent image during said second time period, excess toner being collected and electrically treated so as to separate said charge-bearing solid pigment particles therefrom, substantially particle-free dispersant obtained thereby being returned to said supply tank, and stopping said injecting of said color concentrate of the second color at an end of said second time period, whereby said continuously circulating stream of fluid dispersant rinses said second fluid toner from said circulation path.

10. The method of claim 9 wherein said pigment particles separated from said excess first and second toner are returned to respective tanks of first and second color concentrate.

11. The method of claim 9 wherein injecting and stopping said injecting of said color concentrates comprise respectively turning on and turning off a pump.

12. The method of claim 9 further comprising pre-wetting said surface with fluid dispersant prior to applying said first toner thereto.

* * * * *